US012546060B2

(12) United States Patent
Friesenhahn et al.

(10) Patent No.: US 12,546,060 B2
(45) Date of Patent: Feb. 10, 2026

(54) INSTALLATION AND METHOD FOR PRODUCING A FIBROUS MATERIAL WEB

(71) Applicant: Voith Patent GmbH, Heidenheim (DE)

(72) Inventors: Egon Friesenhahn, Aachen (DE); Rainer Falkenberg, Vettweiss (DE); Andreas Schilz, Aachen (DE); Ralf Schröder, Jülich (DE)

(73) Assignee: Voith Patent GmbH, Heidenheim (DE)

( * ) Notice: Subject to any disclaimer, the term of this patent is extended or adjusted under 35 U.S.C. 154(b) by 175 days.

(21) Appl. No.: 18/466,149

(22) Filed: Sep. 13, 2023

(65) Prior Publication Data

US 2024/0084508 A1 Mar. 14, 2024

(30) Foreign Application Priority Data

Sep. 13, 2022 (DE) ..... 10 2022 123 265.4

(51) Int. Cl.
*D21F 9/00* (2006.01)
*D21F 5/02* (2006.01)

(52) U.S. Cl.
CPC . *D21F 5/02* (2013.01); *D21F 9/00* (2013.01)

(58) Field of Classification Search
CPC ..... D21F 5/02; D21F 9/00
USPC ..... 162/232
See application file for complete search history.

(56) References Cited

U.S. PATENT DOCUMENTS 5,893,505 A * 4/1999 Mueller ..... D21F 5/042 242/615.11
8,152,968 B2 * 4/2012 Meuser ..... D21F 9/00 162/266
2007/0039703 A1 2/2007 Lee et al.

FOREIGN PATENT DOCUMENTS

WO 2009144195 A1 12/2009

* cited by examiner

*Primary Examiner* — Jacob T Minskey
(74) *Attorney, Agent, or Firm* — Laurence A. Greenberg; Werner H. Stemer; Ralph E. Locher

(57) ABSTRACT

An installation for producing a fibrous material web, in particular a long-fiber paper or wet nonwoven web, contains a binder wire section having a binder wire for applying an aqueous binder to the fibrous material web, and a dryer section having a dryer fabric for drying and consolidating the fibrous material web. The binder wire section and the dryer section are arranged at a distance from each other, so that the fibrous material web is led from the binder wire to the dryer fabric in a free draw. At least one air extraction device is arranged at the edge of the installation in the region of the distance between the binder wire section and the dryer section.

20 Claims, 4 Drawing Sheets

INSTALLATION AND METHOD FOR PRODUCING A FIBROUS MATERIAL WEB

CROSS-REFERENCE TO RELATED APPLICATION

This application claims the priority, under 35 U.S.C. § 119, of German Patent Application DE 10 2022 123 265.4, filed Sep. 13, 2022; the prior application is herewith incorporated by reference in its entirety.

FIELD AND BACKGROUND OF THE INVENTION

The invention relates to an installation for producing a fibrous material web, in particular a long-fiber paper or wet nonwoven web, containing a binder wire section having a binder wire for applying an aqueous binder to the fibrous material web, and a dryer section having a dryer fabric for drying and consolidating the fibrous material web. The binder wire section and the dryer section are arranged at a distance from each other, so that the fibrous material web is led from the binder wire to the dryer fabric in a free draw.

An installation of this type is already known from international patent disclosure WO 2009/144195 A1, corresponding to U.S. Pat. No. 8,152,968, from the applicant.

In the installation described there, for example, a glass fiber slurry is produced in a fibrous material suspension unit by adding a glass fiber having a fiber length in the range from 6 to 40 mm, preferably from 8 to 30 mm, in particular from 10 to 25 mm, to a typical whitewater in a pulper for dispersion of the glass fiber in the whitewater, forming the glass fiber slurry with a fiber concentration of about 0.2 to 1.0 percent by weight, and is allocated to a whitewater stream. In a web former having at least one at least single-layer, preferably multi-layer headbox, this glass fiber slurry is then applied to an inclined wire which extends at an angle to the horizontal, at least in sections, and is dewatered. As a result of dewatering the glass fiber slurry, a glass fiber wet-laid nonwoven material is formed. The glass fiber wet-laid nonwoven material formed is then transferred to a binder wire of a binder wire section which, at least in segments, runs horizontally or approximately horizontally. In this binder wire section, at least one aqueous binder, such as an aqueous urea formaldehyde (UF) resin-based binder, is applied to the wet glass fiber wet-laid nonwoven by means of at least one binder headbox. The excess binder is then sucked away. The aqueous binder solution is preferably applied by using a curtain coater or a dip-and-squeeze applicator to the wet glass fiber wet-laid nonwoven; however, other application methods such as spraying are also suitable. The wet and still unbonded glass fiber wet-laid nonwoven is then transferred into a dryer section having a dryer fabric for drying and curing (polymerization) of the binder, which bonds the glass fibers to one another in the glass fiber nonwoven. The dryer section can, for example, have a heated flow heater or a cylinder dryer or belt dryer, the glass fiber nonwoven generally being subjected to a temperature of 100 to 250° C. but not for longer than 1 to 2 minutes. Finally, the glass fiber nonwoven, which has a weight per unit area range from 40 to 200 g/m2 and a binder proportion of 10 to 30%, is wound up in a winder onto winder cores to form wound rolls, in order then to be able to be supplied to following converting or processing stations.

The following problem has already been pointed out in international patent disclosure WO 2009/144195 A1, which occurs when the still wet and still unbonded glass fiber nonwoven is transferred from the binder wire to the dryer fabric if, for example, a transfer roll is used instead of an open draw: The roll surface is very quickly contaminated with glass fibers as soon as it comes into contact with the glass fiber wet-laid nonwoven, which is very wet and tacky because of the binder application. This contamination causes a high production loss and associated poor "runability", since the installation must be stopped completely and the roll contaminated with glass fibers must be cleaned. Individually, although designs are used for the purpose of "online" roll cleaning, the cleaning results that can be achieved thereby are more than unsatisfactory, both with regard to the cleaning qualities and also the cleaning times. In addition the costs for such constructions, amongst other things as a result of the necessity to keep a spare roll in reserve, cannot usually be disregarded.

In international patent disclosure WO 2009/144195 A1 it is proposed to omit the roll or the like and to transfer the fibrous material web from the binder wire to the dryer fabric in a free draw, wherein the web in this region is supported by an airflow from a blowing device for the non-contact floating guidance of the fibrous material web. The blowing device extends here over the entire width of the nonwoven material web, wherein it blows air onto the latter from above.

Although this concept has proven worthwhile, in practice during the transfer of the fibrous material web from the binder wire to the dryer fabric in the free draw, the problem arises from time to time that creases form in the fibrous material web during the transfer, which to some extent leads to breakages of the web. The problem occurs all the more often the higher the speed with which the web is led through the installation and/or the lower the weight per unit area of the web is.

SUMMARY OF THE INVENTION

The invention is based on the object of avoiding or at least reducing the aforementioned problems. In particular, the transfer of the wet and still unbonded fibrous material web from the binder web section into the dryer section in the open draw should be configured to be more reliable, so that it has no detrimental effect on the runability of the installation and also functions at high machine speeds and/or low specific web weights without creasing and/or breakage of the web.

This object is achieved by the features of the independent claims. Advantageous developments of the invention are the subject matter of the dependent claims. In particular, in an installation of the type mentioned at the beginning, the object is achieved, according to the invention, in that at least one air extraction device is arranged at the edge of the installation in the region of the distance between the binder wire section and the dryer section.

The inventors have recognized that the cause of the creasing of the fibrous material web is primarily the airflows which—in particular at high operating speeds and/or low weights per unit area of the web—are produced by the binder wire and the dryer fabric running in the opposite direction in the transfer region between the binder wire and dryer sections. These airflows produce turbulences, in particular in the edge region of the installation. As a result, the fibrous material web is stretched, which leads to creasing or even the breakages of the web in the installation. This is illustrated schematically in FIG. 2, described further in more detail below.

A first approach to a solution for influencing the airflow positively was to operate with guide plates. In the regions in which airflows influence the web run, flow guides in the form of guide plates are used here. These deflect the airflow such that the web run is not impaired. However, this approach to a solution had the disadvantage that the airflows can be variable. Depending on the time of year, temperature in the hall or whether the shutters or doors in the hall are open or closed, the thermal conditions, and therefore the flow in the area considered, change. This results in the position of the guide plate having to be changed again and again in order to ensure trouble-free operation.

This problem could be solved only by the use according to the invention of at least one air extraction device. The at least one air extraction device permits a stable flow, which is not affected by the aforementioned interference factors, to be generated specifically in the transfer region between the binder wire and dryer sections.

Surprisingly, it has transpired here that it is completely sufficient for this purpose to arrange the at least one air extraction device only at the edge. This had previously not been expected. Had it proven to be necessary for stable air guidance in the transfer region to provide an air extraction device which extends underneath the fibrous material web in the transfer region substantially over the entire width of the installation, this would have inevitably led to a very high outlay on maintenance and cleaning for the air extraction device since, in the transfer region, fibers which were sticky as a result of the binder repeatedly fall off the still wet and still unbonded fibrous material web. Therefore, even this approach to a solution with the at least one air extraction device would have been impractical.

Preferably, as viewed in the vertical direction, the at least one air extraction device is arranged here substantially underneath the fibrous material web guided in the free draw, but not extending from the edge of the installation as far as under the fibrous material web guided in the free draw. Here, "substantially underneath as viewed in the vertical direction" means that the at least one air extraction device is arranged in the vertical direction, i.e. in the direction of gravity, predominantly, preferably completely, underneath the fibrous material web if, in the intended operation of the installation, the latter is guided from the binder wire section to the dryer section. At the same time, the at least one edge-side air extraction device, viewed in the horizontal direction, is not intended to extend from the edge as far as under the fibrous material web transferred in the free draw, however, in order thus to avoid the aforementioned problems of the high outlay on cleaning and maintenance.

The term "air extraction device" preferably means here a suction box. Such a suction box normally has an opening area over which the air is extracted. The air extraction device can be connected to a negative pressure source, such as a vacuum pump, via pipelines or the like.

The invention has proven to be particularly efficient if an air extraction device is respectively arranged both on the drive side and on the operator's side of the installation. In this case, it is advantageous if the drive-side and the operator's-side air extraction devices are designed in such a way that the negative pressure originating therefrom can be adjusted independently of each other. In other words, it is not necessary for the same negative pressure always to be applied to both air extraction devices or for the same quantity of air per unit time to be extracted. The adjustment can be made via a closed-loop or an open-loop control system. Normally, however, it is sufficient to set the negative pressure only once.

In order in general to avoid or at least to reduce the above-described contamination and maintenance problems, it is advantageous if the installation space underneath the fibrous material web guided in the free draw is kept free at least in the region between a last roll of the binder wire section, over which the binder wire is guided when the latter delivers the fibrous material web, and a first roll of the dryer section, over which the dryer fabric is guided when the latter picks up the fibrous material web. Air can then be extracted particularly efficiently from this free installation space by the at least one, preferably two, air extraction device(s).

With regard to an efficient configuration of the binder section, it is proposed that the binder wire runs at least in some sections horizontally or approximately horizontally and/or the binder wire section has at least one binder headbox.

In addition, it is advantageous if the installation also contains a forming section for dewatering an aqueous suspension, which is placed upstream of the binder wire section in the processing direction of the fibrous material web through the installation, wherein the forming section preferably contains an inclined wire former, which has an inclined wire extending at an angle to the horizontal, at least in some segments, and at least one at least single-layer, preferably multi-layer, headbox.

In addition, the installation can further comprise a fibrous material suspension unit for producing the aqueous suspension for the forming section.

At the end, the installation can additionally further have a winder for continuously winding up the fibrous material web onto winder cores to form wound rolls, wherein the winder is placed after the dryer section in the processing direction of the fibrous material web through the installation.

It is not necessarily possible, however, that at least one, preferably positionable, blowing device for the non-contact floating guidance of the fibrous material web by means of air or another free-flowing medium is provided between the binder wire section and the dryer section, having a plurality of blowing zones that can be controlled/regulated independently of one another transversely to the running direction of the fibrous material web. The mode of action of such a blowing device, which blows onto the fibrous material web from above in the transfer region in order to promote non-contact floating guidance of the fibrous material web, is described in detail in international patent disclosure WO 2009/144195 A1 mentioned at the beginning, to the content of which in this respect and with respect to further advantageous refinements of the blowing device reference is hereby expressly made.

A further aspect of the present invention relates to the use of a previously described installation according to the invention for producing a fibrous material web, in particular a long-fiber paper or wet-laid nonwoven web, wherein in intended operation of the installation air is extracted from the region between the binder wire section and the dryer section by means of the at least one edge-side air extraction device.

The present invention has proven here to be particularly efficient if the fibrous material web is a wet-laid glass nonwoven web. In particular, the transfer of the still not yet dry and therefore tacky glass fiber nonwoven from the binder wire section to the dryer section is particularly susceptible to the contamination problems described above.

Furthermore, the advantages of the present invention come into play particularly well if the fibrous material web is produced at a speed of at least 170 m/min and/or if the fibrous material web has a weight per unit area of less than 30 g/m$^2$, since here the danger of creasing of the fibrous material web in the transfer region between the binder wire and dryer sections is particularly high.

Other features which are considered as characteristic for the invention are set forth in the appended claims.

Although the invention is illustrated and described herein as embodied in an installation for producing a fibrous material web, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
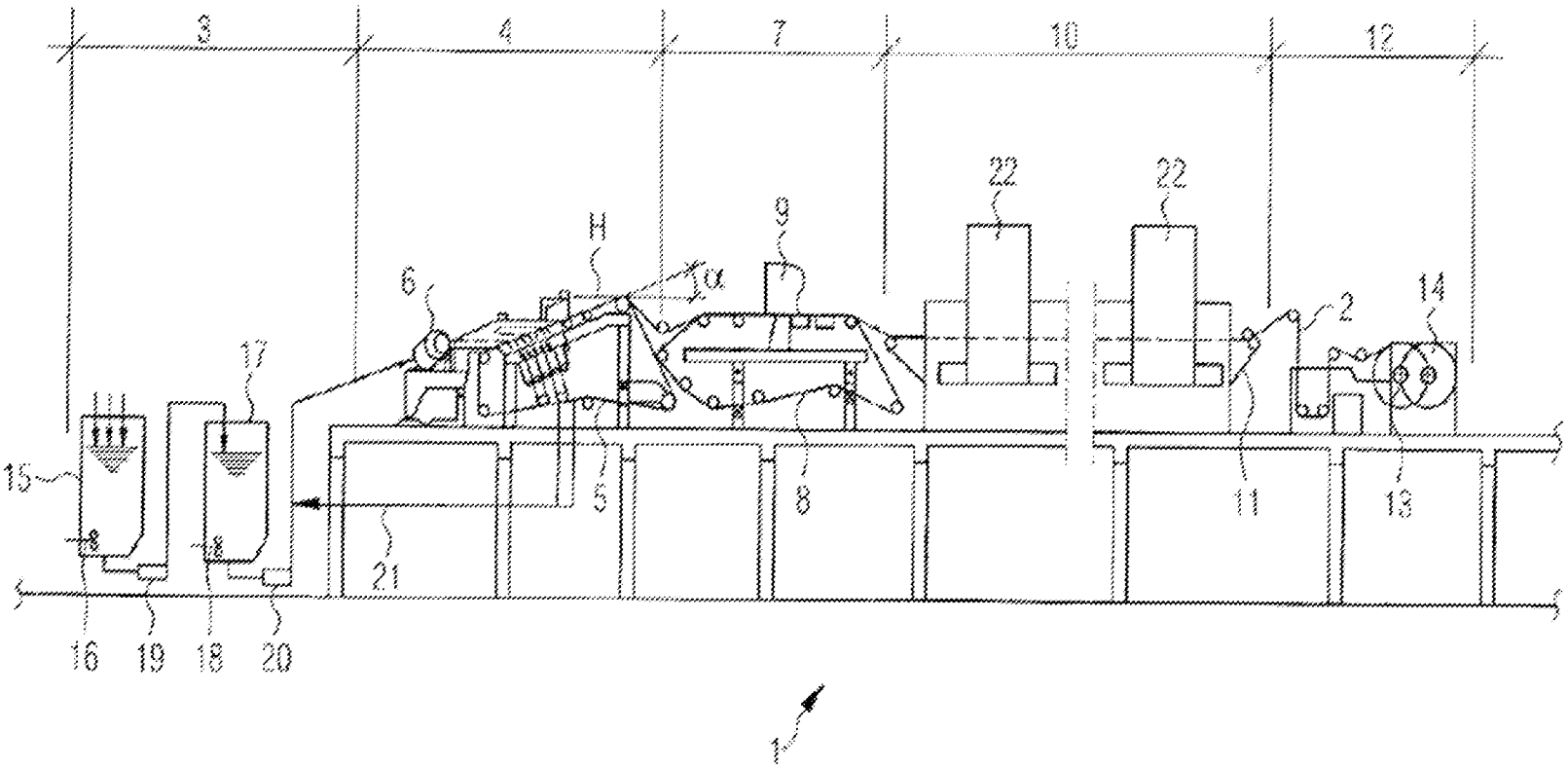
Fig. 1 Prior art
FIG. 1 is a diagrammatic layout of an installation for producing a fibrous material web according to the prior art.

Referring now to the figures of the drawings in detail and first, particularly to FIG. 1 thereof, there is shown a schematic layout of an installation 1 for producing a fibrous material web 2, in particular a long-fiber paper or wet-laid nonwoven web.

This installation 1 for producing the fibrous material web 2 contains a fibrous material suspension unit 3, a forming section 4, which has an inclined wire 5 running at an angle $\alpha$ to the horizontal H, at least in some sections, and at least one at least one-layer, preferably multi-layer, headbox 6, a binder wire section 7, which has a binder wire 8 running at least in some segments horizontally or approximately horizontally, and at least one binder headbox 9, a dryer section 10 having a dryer fabric 11 and a winder 12 for continuously winding up the fibrous material web 2 onto winder cores 13 to form wound rolls 14.

In the fibrous material suspension unit 3, all the components needed to produce an aqueous suspension, such as water, cut fibers, binder and the like, are put into a first container ("pulper") 15 provided with an agitator 16 and, after that, into a second container ("pulper") 17 likewise provided with an agitator 18; the transport of the aqueous suspension is performed by the pumps 19, 20. The aqueous suspension can be, for example, a glass fiber slurry, which comprises glass fibers with a fiber length in the range from 6 to 40 mm, preferably from 8 to 30 mm, in particular from 10 to 25 mm, and so-called whitewater, and has a fiber concentration of about 0.2 to 1.0 percent by weight.

The fibrous material suspension unit 3 is followed by the next process stage, namely the dewatering of the aqueous suspension and the forming of the fibrous material web 2 with the aid of the inclined wire 5 arranged in the forming section 4. To this end, the aqueous suspension is applied to the inclined wire 5 by means of an at least single-layer, preferably multi-layer, headbox 6. The water filtered off out of the aqueous suspension underneath the inclined wire 5 is fed back in the circuit according to the arrow 21 and, for example, admixed with the aqueous suspension leaving the second container ("pulper") 17 of the fibrous material suspension unit 3.

In the following process stage, at least one aqueous binder, such as an aqueous urea formaldehyde (UF) resin-based binder, is applied by means of a binder headbox 9 to the fibrous material web 2, which is still wet and resting on the binder wire 8 of the binder wire section 7. After that, the excess binder is also extracted in a known way in this binder wire section 7. The aqueous binder can also be applied to the still wet fibrous material web 2 in a manner not illustrated by using a curtain coater or a dip-and-squeeze applicator; however other application methods, such as spraying, are also suitable.

The next process stage is used for the drying and consolidation of the still wet fibrous material web 2 by means of curing (polymerization) of the binder, which bonds the glass fibers in the glass fiber nonwoven to one another. To this end, it is led through the dryer section 10 having the dryer fabric 11, which has two heated and illustrated continuous-flow ovens 22 or a drum or belt dryer, not illustrated. The fibrous material web 2 here is generally exposed to a temperature of 100° C. to 250° C. but for no longer than 1 to 2 minutes.

In a last process stage, the fibrous material web, having a mass per unit area range from 40 to 200 g/m$^2$ and a binder proportion of 10 to 30%, is wound up in the winder 12 onto winder cores 14 to form wound rolls 13, in order then to be able to be supplied to following conversion or processing stations.

Between the binder wire section 7 and the dryer section 10, an adjustable blowing device (not illustrated) for the non-contact floating guidance of the fibrous material web 2 by means of air or another free-flowing medium can further be provided, having a plurality of blowing zones that can be controlled/regulated independently of one another transversely to the running direction of the fibrous material web 2.

Figure 2:
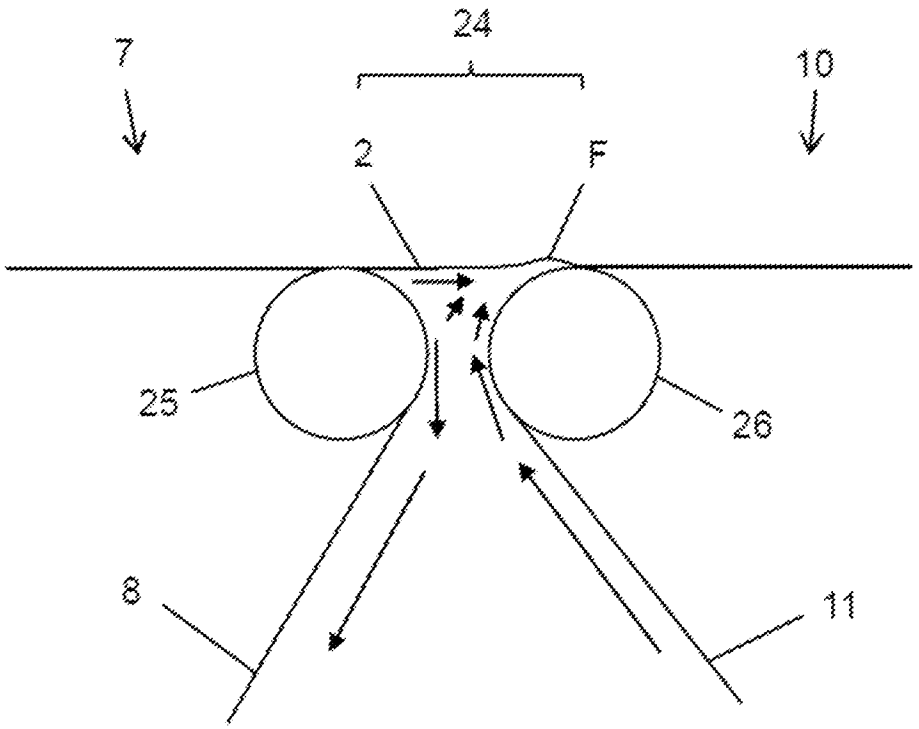
Fig. 2 Prior art
FIG. 2 is a diagrammatic, side view of a transfer region between a binder wire and dryer sections according to the prior art.

FIG. 2 shows the transfer region 24 between the binder wire section 7 and the dryer section 10 in a schematic side view, and also the problem of the formation of creases F in the prior art. The fibrous material web 2 is transported on the binder wire 8 as far as a last roller 25 of the binder wire section 7, then guided in a free draw as far as a first roller 26 of the following dryer section 10, where it is picked up by the dryer fabric 11 and transported onward. The arrows with the filled tips illustrate here the flows of the air which is entrained by the binder wire 8 of the fibrous material web 2 and the dryer fabric 11 on their surfaces. As a result of these airflows, turbulences occur in the interspace between the two rolls 25 and 26, which have a detrimental effect on the fibrous material web 2 guided in the free draw. In particular, shortly before the fibrous material web 2 is guided onto the dryer fabric 11, it tends to form creases F. This creasing is critical for the further conversion process of the fibrous material web 2 and can even lead to the breakage of the fibrous material web 2.

Figure 3:
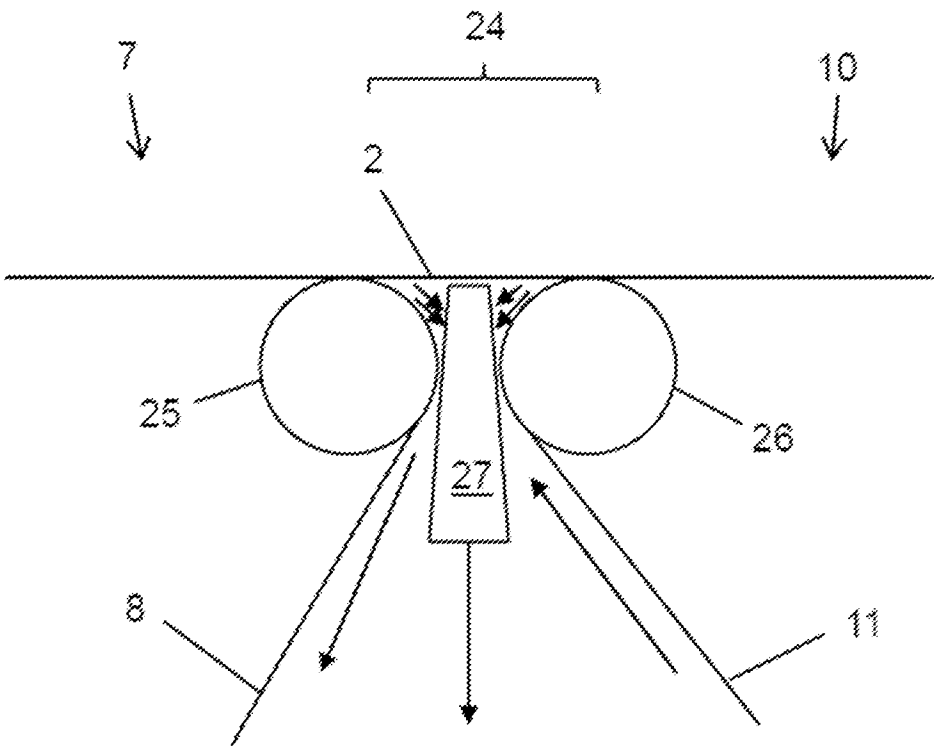
FIG. 3 is a diagrammatic, side view of the transfer region between the binder wire and dryer sections according to the invention of the instant application.

FIG. 3 shows substantially the same schematic side view of the transfer region 24 as FIG. 2 but with the solution according to the invention, which prevents the creasing of the fibrous material web 2. A substantial constituent part of this solution is an air extraction device 27, which is arranged in the transfer region 24 underneath the fibrous material web 2 in the vertical direction but at the edge of the fibrous material web 2 guided in the free draw. In other words, the air extraction device 27 is not located directly under the fibrous material web 2 but is arranged offset laterally relative to the latter in the machine transverse direction (direction orthogonal to the image plane of FIG. 2). The air extraction device 27 has an opening area 28 (cf. FIG. 4) which is directed toward the free interspace between the two rolls 25 and 26 in order to extract air from this interspace and then to carry it away deliberately (cf. arrow downward from the air extraction device 27). In this way, turbulences in the transfer region 24 between the two rolls 25 and 26 can largely be avoided, so that the fibrous material web 2 has no danger of forming creases F. At the same time, as a result of its edge-side arrangement relative to the still unbonded fibrous material web 2, the air extraction device 27 is largely protected from contaminants from the latter.

Figure 4:
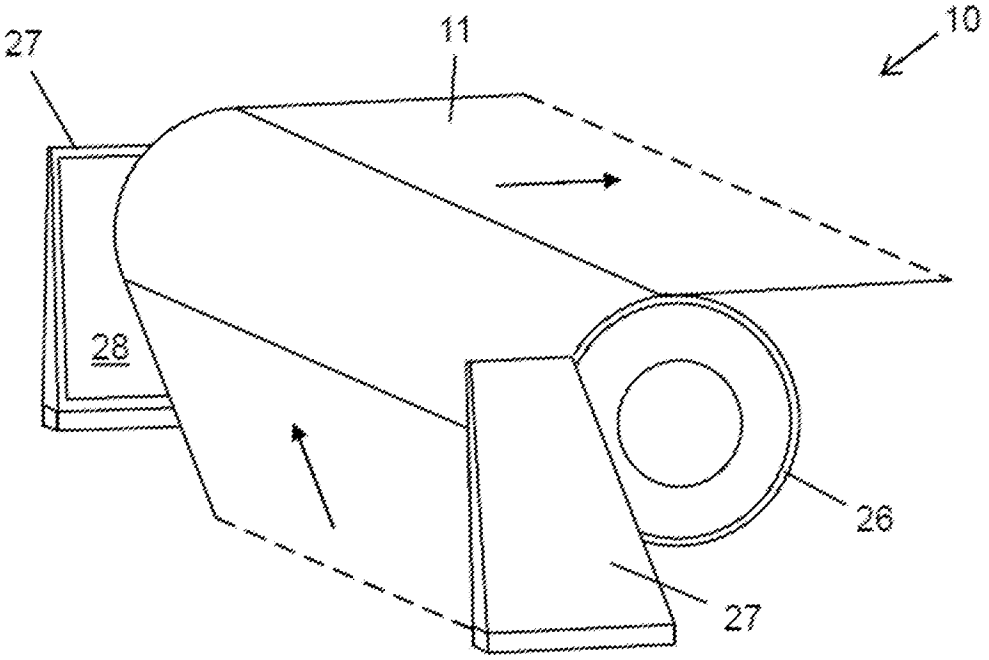
FIG. 4 shows a schematic three-dimensional view of the transfer region between the binder wire and dryer sections according to the present invention.

Preferably, the installation 1 according to the invention has such an air extraction device 27 respectively both on its operator's side and on its drive side, as illustrated schematically in FIG. 4. In the three-dimensional illustration of FIG. 4, for reasons of clarity, only the first roller 26 of the dryer section 10, part of the dryer fabric 11, which is moved in the direction of the arrow, and the two edge-side air extraction devices 27 are shown here. The aforementioned opening area 28 can be seen in one of these two air extraction devices 27. The two air extraction devices 27 are configured as suction boxes here.

The following is a summary list of reference numerals and the corresponding structure used in the above description of the invention.

LIST OF DESIGNATIONS

1 Installation
2 Fibrous material web
3 Fibrous material suspension unit
4 Forming section
5 Inclined wire
6 Headbox
7 Binder wire section
8 Binder wire
9 Binder headbox
10 Dryer section
11 Dryer fabric
12 Winder
13 Winder core
14 Wound roll
15 First container ("Pulper")
16 Agitator
17 Second container ("Pulper")
18 Agitator
19, 20 Pumps
21 Feedback circuit
22 Continuous-flow oven
24 Transfer region
25 Last roll of the binder wire section
26 First roll of the dryer section
27 Air extraction device
28 Opening area
α Angle
F Crease
H Horizontal

The invention claimed is:

1. An installation for producing a fibrous material web, comprising:

a binder wire section having a binder wire for applying an aqueous binder to the fibrous material web;

a dryer section having a dryer fabric for drying and consolidating the fibrous material web, wherein said binder wire section and said dryer section are disposed at a distance from each other, so that the fibrous material web is led from said binder wire to said dryer fabric in a free draw; and at least one air extraction device disposed only at an edge of the installation in a region of a distance between said binder wire section and said dryer section.

2. The installation according to claim 1, wherein as viewed in a vertical direction, said at least one air extraction device is disposed substantially underneath the fibrous material web guided in the free draw, but not extending from the edge of the installation as far as under the fibrous material web guided in the free draw.

3. The installation according to claim 1, wherein said at least one air extraction device is a suction box.

4. The installation according to claim 1, wherein said at least one air extraction device is one of two extraction devices with one of said extraction devices disposed on a drive-side of the installation and another of said extraction devices disposed on an operator's-side of the installation.

5. The installation according to claim 4, wherein said extraction devices are configured such that a negative pressure originating from said extraction devices can be adjusted independently of each other.

6. The installation according to claim 1, wherein installation space underneath the fibrous material web guided in the free draw is kept free at least in a region between a last roller of said binder wire section, over which said binder wire is guided when said binder wire delivers the fibrous material web, and a first roller of said dryer section, over which said dryer fabric is guided when said dryer fabric picks up the fibrous material web.

7. The installation according to claim 1, wherein said binder wire runs at least in some sections horizontally or approximately horizontally and/or said binder wire section has at least one binder headbox.

8. The installation according to claim 1, further comprising a forming section for dewatering an aqueous suspension, which is placed upstream of said binder wire section in a processing direction of the fibrous material web through the installation.

9. The installation according to claim 8, further comprising a fibrous material suspension unit for producing the aqueous suspension for said forming section.

10. The installation according to claim 8, wherein said forming section contains an inclined wire former, which has an inclined wire extending at an angle to a horizontal at least in some segments, and at least one single-layer headbox.

11. The installation according to claim 10, wherein said single-layer headbox is a multi-layer headbox.

12. The installation according to claim 1, further comprising a winder for continuously winding up the fibrous material web onto winder cores to form wound rolls, wherein said winder is placed after said dryer section in the processing direction of the fibrous material web through the installation.

13. The installation according to claim 1, further comprising at least one blowing device for a non-contact floating guidance of the fibrous material web by means of air or another free-flowing medium is provided between said binder wire section and said dryer section, having a plurality of blowing zones that can be controlled/regulated independently of one another transversely to a running direction of the fibrous material web.

14. The installation according to claim 1, wherein the fibrous material web is a long-fiber paper or a wet nonwoven web.

15. The installation according to claim 13, wherein said at least one blowing device is a positionable blowing device.

16. A method for producing a fibrous web material, which comprises the steps of:

providing an installation containing a binder wire section having a binder wire for applying an aqueous binder to the fibrous material web, and a dryer section having a dryer fabric for drying and consolidating the fibrous material web, wherein the binder wire section and the dryer section are disposed at a distance from each other, so that the fibrous material web is led from the binder wire to the dryer fabric in a free draw, the installation further having at least one air extraction device disposed only at an edge of the installation in a region of a distance between the binder wire section and the dryer section; and during an intended operation of the installation air is extracted from the region between the binder wire section and the dryer section by means of the at least one edge-side air extraction device.

17. The method according to claim 16, wherein the fibrous material web is a wet-laid glass nonwoven web.

18. The method according to claim 16, which further comprises producing the fibrous material web at a speed of at least 170 m/min.

19. The method according to claim 16, wherein the fibrous material web has a weight per unit area of less than 30 $g/m^2$.

20. The method according to claim 16, wherein the fibrous web material is a long-fiber paper or a wet-laid nonwoven web.

* * * * *